United States Patent [19]

Harada et al.

[11] Patent Number: 4,787,314

[45] Date of Patent: Nov. 29, 1988

[54] DEVICE FOR REMOVING WATER FROM MESHED ROLL

[75] Inventors: Noritake Harada, Yokohama; Yukitoshi Takahashi; Masayoshi Sato, both of Kawasaki,, Japan

[73] Assignee: Kabushiki Kaisha Tokyo Kikai Seisakusho, Tokyo, Japan

[21] Appl. No.: 924,048

[22] Filed: Oct. 28, 1986

[30] Foreign Application Priority Data

Jun. 9, 1986 [JP] Japan ..... 61-132958

[51] Int. Cl.[4] ..... B41F 35/00; B41F 31/00

[52] U.S. Cl. ..... 101/425; 101/148; 101/350

[58] Field of Search ..... 101/148, 425, 350, 147

[56] References Cited

U.S. PATENT DOCUMENTS

| | | | |
|---|---|---|---|
| 3,411,441 | 11/1968 | Hermach et al. | 101/148 |
| 3,737,940 | 6/1973 | Moestue et al. | 101/425 X |
| 3,926,116 | 12/1975 | Wildeman | 101/352 X |
| 4,040,348 | 8/1977 | Gertsch et al. | 101/148 X |
| 4,143,596 | 3/1979 | Ivett | 101/148 |
| 4,211,167 | 7/1980 | Corse | 101/148 |
| 4,270,450 | 6/1981 | Difflipp et al. | 101/425 X |
| 4,351,236 | 9/1982 | Beisel et al. | 101/352 X |
| 4,414,897 | 11/1983 | Sato et al. | 101/216 |
| 4,527,479 | 7/1985 | Dahlgren et al. | 101/148 X |
| 4,624,182 | 11/1986 | Pyliotis | 101/425 X |
| 4,637,310 | 1/1987 | Sato et al. | 101/426 |

FOREIGN PATENT DOCUMENTS

| | | | |
|---|---|---|---|
| 175635 | 11/1985 | Japan | 101/148 |
| 25139 | 2/1986 | Japan | 101/148 |
| 25137 | 2/1986 | Japan | 101/148 |

*Primary Examiner*—Clifford D. Crowder

*Attorney, Agent, or Firm*—Trexler, Bushnell, Giangiorgi & Blackstone, Ltd.

[57] ABSTRACT

A device for removing water from the returning portion of the peripheral surface of a meshed roll mounted in a planographic printing press comprises at least one roll for removing water pressed against the said returning portion. The peripheral surface of the roll is made of soft and smoothed material, or brushes project to the centrifugal direction from the peripheral surface of the roll. In one embodiment, a smooth roll of rubber or soft resin presses against the meshed roll, a second smooth roll of metal contacts it, a blade scrapes the second roll and a container receives recovered water from the blade.

1 Claim, 3 Drawing Sheets

DEVICE FOR REMOVING WATER FROM MESHED ROLL

FIELD OF THE INVENTION

The present invention relates to a planographic printing machine including a flat plate adapted for offset printing or direct printing, an inking roll train, and a meshed roll disposed in the train and, more particularly, to a device for removing such water from the returning portion of the periphery of the meshed roll that intrudingly arrives on the periphery after ink has been transferred from the roll.

BACKGROUND OF THE INVENTION

In a general,conventional planographic printing machine, the amount of moisturing water supplied to the cylinder has been controlled according to the non-printing area that needs the water most. Since the same amount of water is supplied to the printing area that does not need it, the superfluous water is forced into the ink supply system via the returning portion of the periphery of the inking roll.

However, the conventional ink supply system does not suffer from serious disadvantages, because the ink once taken out of an ink supply source is not returned to the source, and because the inking train consists of as many as about a dozen of rolls, substantially eliminating the possibility that the superfluous water intrudes into the supply source.

Recently, as shown in FIG. 1, a meshed roll 3 has been introduced in a planographic printing system. This roll can dispense with a number of inking roll, but poses problems as described below. The meshed roll 3 is connected to a cylinder 5 via only one pair of inking rolls, 4 and 4*a*. The superfluous water 7 supplied from a moisturing water supply system 6 to the cylinder 5 flows along the returning portion of the periphery of the inking roll 4, and then intrudingly arrives on the returning portion of the periphery of the meshed roll 3. Subsequently, the water is conveyed to the returning portion 8*a* of the periphery of a fountain roll 8 and added to the ink stored in an ink pan 9.

The meshed roll 3 is supplied with ink in a peculiar fashion. Specifically, all the ink supplied from the fountain roll 8 to the periphery of the meshed roll 3 is always scraped off by a doctor blade 10 except for the ink contained in the meshes of the roll 3. The scraped superfluous ink is returned into the pan 9, which also contains water. Thereafter, the ink adheres to the periphery of the fountain roll 8, and is again supplied to the roll 3. If water is introduced into the resupplied ink, then the nature of the ink varies, lowering the quality of the printed paper. In addition, after ink is transferred out of the meshed roll 3, water intrudes into the meshes. Thus, ink is less likely to enter the meshes. If water becomes superfluous locally on the roll, then ink is not transferred to the roll. This phenomenon is known as stripping.

SUMMARY OF THE INVENTION

It is an object of the present invention to provide a water-removing device which eliminates the foregoing difficulties and which can prevent superfluous water reaching the returning portion of the periphery of a meshed roll from intruding into an ink supply system.

The above object is achieved in accordance with the teachings of the invention by a device for removing water from a meshed roll, the device comprising one or more water-removing rolls which are pressed against the returning portion of the periphery of the meshed roll after ink is transferred out of this roll.

In one embodiment of the invention, the device constructed as described in the preceding paragraph further includes a water-removing blade pressed against the periphery of the roll and a container disposed below the blade to recover water.

In another embodiment of the invention, a roll that follows the aforementioned water-removing roll is provided to constitute a roll train.

In further embodiment of the invention, a brush roll rotatably pressed against the returning portion of the meshed roll after ink is transferred out of this roll.

In furthermore embodiment of the invention, the device constructed as described in the preceding paragraph further includes a water-removing blade pressed against the periphery of the brush roll.

In accordance with the invention, the superfluous water intrudingly reaching on the returning portion of the periphery of the meshed roll is forced against the periphery. The resulting abrupt pressure change causes some of the superfluous water to be added to ink and emulsified. The remaining water not emulsified is rolled into a thin film by the pressing, and evaporates into the atmosphere. Since this process is repeated whenever the water is pressed between rolls, the water is effectively removed accordingly.

Where two or more rolls are pressed on the returning portion of the periphery of the meshed roll, the above-described process occurs for each different roll. Therefore, water can be removed more efficiently.

In the brush roll, brushes are, at first, pressed against the peripheral surface of the meshed roll, so that they are bent in close together, and water is gathered in the closed bending portion of the brushes by capillarity. As soon as the brushes free from pressure of the meshed roll according to the rotation of the brush roll, the brushes return to straighten from the bending state by its own elasticity, and water to which gathered in the closed bending portion of the brushes is swept away.

Other objects and features of the invention will appear in the course of the description thereof which follows.

DETAILED DESCRIPTION OF THE INVENTION

Figure 1:
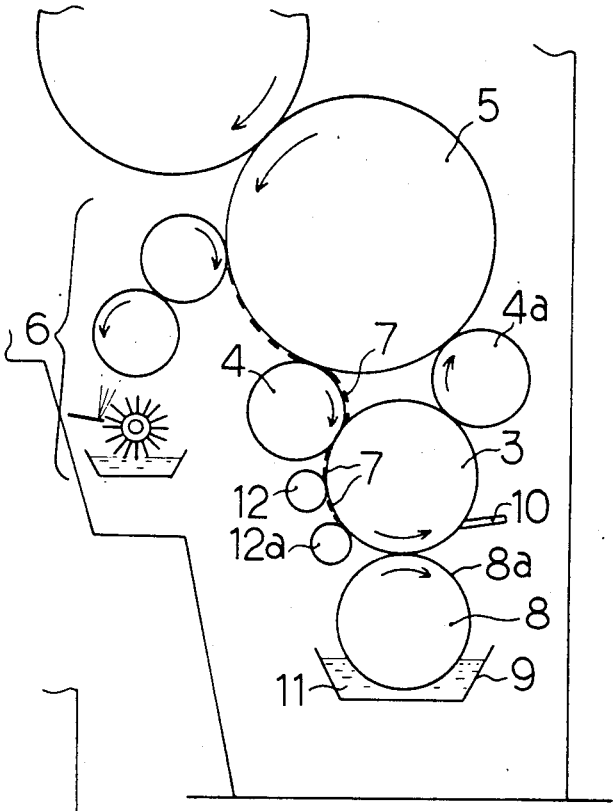
FIG. 1 is a schematic representation of a water-removing device according to the invention.

Referring to FIG. 1, a planographic printing machine has an ink pan 9 storing ink 11, a fountain roll 8, a meshed roll 3, a doctor blade 10, inking rolls 4, 4*a*, a plate cylinder 5, and a moisturing-water supply system 6. The machine further includes a water-removing roll 12 embodying the concept of the invention. The ink 11 held in the pan 9 is transferred to the meshed roll 3 from the fountain roll 8, and then the ink adhering to the periphery of the roll 3 is scraped off by the doctor blade 10. Only the ink remaining in the meshes of the roll 3 is supplied to the periphery of the plate cylinder 5 via the inking roll 4 or 4*a*. Meanwhile, water is supplied to the periphery of the plate cylinder 5 from the moisturing-water supply system 6. The superfluous water 7 intrudingly arrives on the returning portion of the periphery of the meshed roll 3 via the returning portion of the periphery of the inking roll 4. If the roll 12 pressed against the returning portion of the meshed roll 3 were not provided, then the superfluous water would be added to the ink 11 in the pan 9 via the returning portion 8*a* of the periphery of the fountain roll 8. The roll 12 acts to accelerate the emulsification of the superfluous water 7 in the ink and its evaporation into the atmosphere.

A second water-removing roll 12*a* can be pressed against the returning portion of the periphery of the meshed roll 3. In this case, the superfluous water 7 that has escaped from the first roll 12 is removed by the second roll 12*a*.

If the space allows, third and fourth rolls (not shown) can be pressed against the returning portion of the periphery of the meshed roll 3 to completely remove the superfluous water 7.

Figure 2:
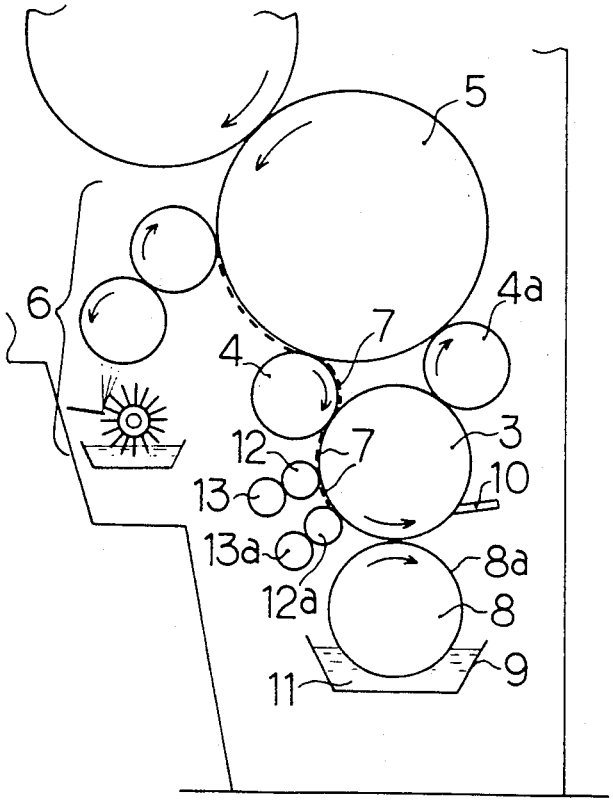
FIG. 2 is a schematic representation of another water-removing device according to the invention.

Referring next to FIG. 2, there is shown another printing machine that is similar to the machine shown in FIG. 1 except that a second roll 13 is in contact with the water-removing roll 12 to constitute a roll train. The roll 12 is pressed against the returning portion of the periphery of the meshed roll 3. Some of the superfluous water 7 pressed between the meshed roll 3 and the first roll 12 is emulsified in the ink. The remaining water not emulsified is transferred to the periphery of the first rod 12 as a thin film, which is then transferred to the periphery of the second roll 13. Thus, the thin film of the superfluous water comes into contact with the atmosphere with a large area. Hence, its evaporation is hastened.

If the space allows, a third roll 12*a* can be pressed against the returning portion of the periphery of the meshed roll 3. A fourth small roll 13*a* can be mounted in contact with the small roll 12*a* to form a second roll train. Also, a third roll train may be provided to more fully process the superfluous water.

Since the meshed roll 3 with which the rolls 12 and 12*a* are in direct contact is made of a metal, the rolls 12 and 12*a* are made of rubber or other soft material. It is desired that the rolls 13 and 13*a* which are in contact with the rolls 12 and 12*a*, respectively, be made of a metal. More preferably, the rolls 13 and 13*a* are plated with chromium that exhibits hydrophilic property. It is also possible, however, to fabricate the rolls 13 and 13*a* from rubber or other soft material.

Figure 3:
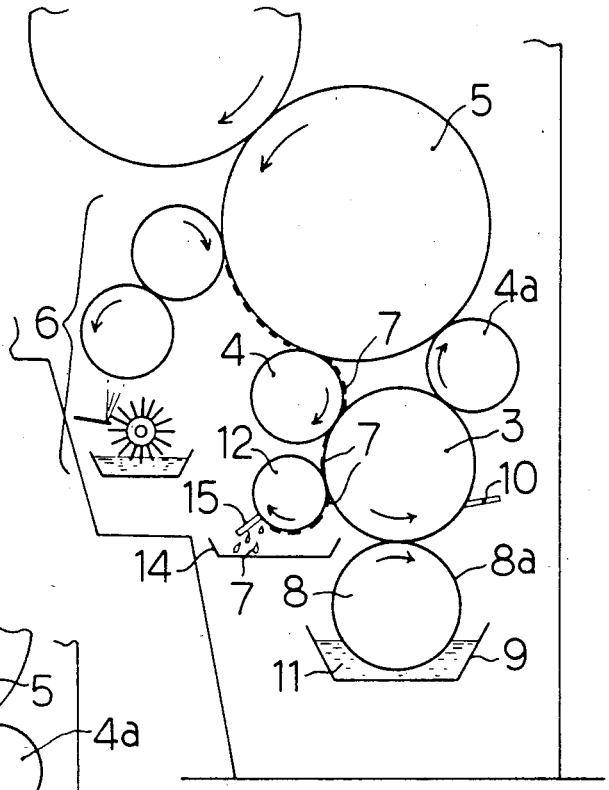
FIG. 3 is a schematic representation of a further water-removing device according to the invention.

Referring next to FIG. 3, there is shown a further printing machine according to the invention. This machine is similar to the machine shown in FIG. 1 except that the front end of a blade 15 is pressed against the periphery of the water-removing roll 12 to scrape the superfluous water 7 from the periphery, and that a pan 14 is disposed below the blade to collect and recover the water.

Preferably, the roll 12 that is in direct contact with the periphery of the meshed roll 3 is made of rubber or soft resin, because, in this case, the roll 12 is in smooth contact with the metallic meshed roll 3. However, that the front end of the blade 15 is pressed against the periphery of the soft roll 12 may present a problem in view of the strength of the material.

Figure 4:
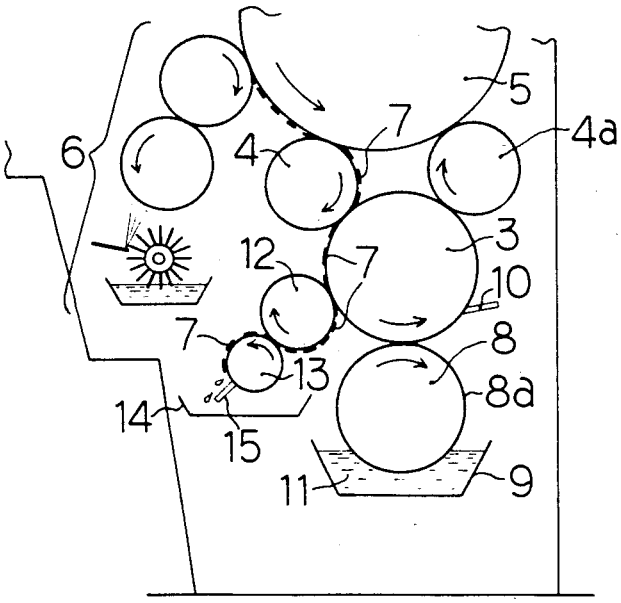
FIG. 4 is a schematic representation of a still other water-removing device according to the invention.

This difficulty is solved by an arrangement constructed as shown in FIG. 4, where a second metallic roll 13 is pressed against the periphery of the soft roll 12. The front end of the blade 15 is pressed against the periphery of the metallic roll.

Usually, the superfluous water 7 collected in the pan 14 is discharged. In view of the fact that the water contains a large amount of ink, a water-removing device (not shown) may be mounted to recover ink from the water. The recovered ink is then returned into the ink pan 9.

Figure 5:
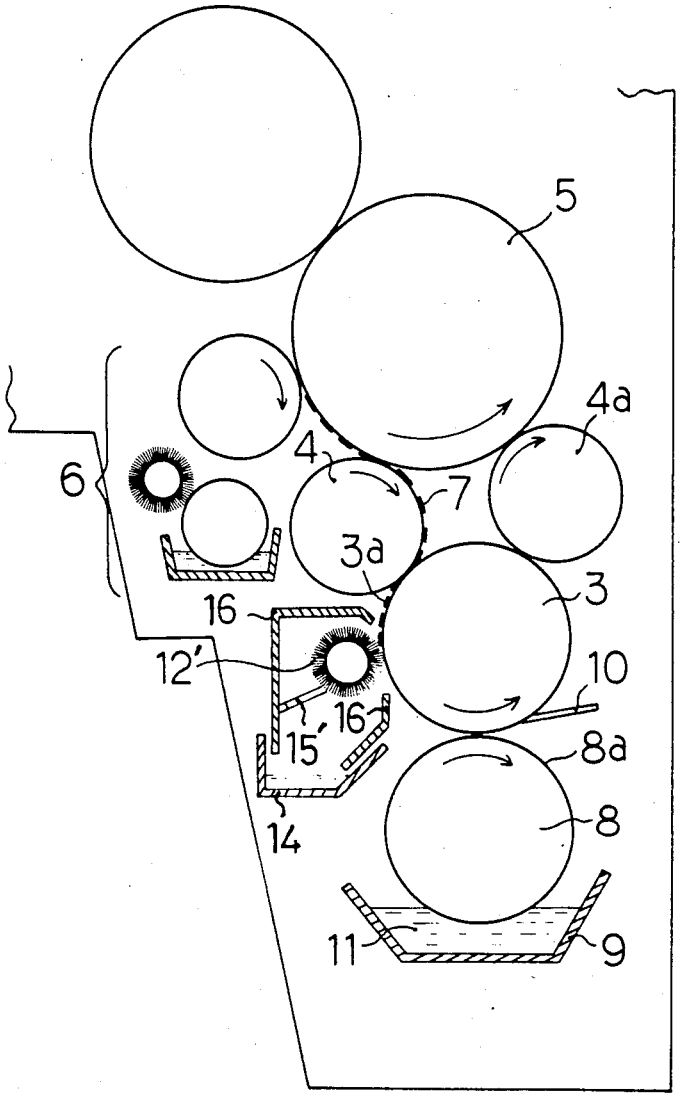
FIG. 5 is a schematic representation of a more still other water-removing device according to the invention.

Referring next to FIG. 5, there is shown still another printing machine that is similar to the machine shown in FIG. 1 except that a brush roll 12' is rotatably pressed against the returning surface 3*a* of the meshed roll 3 after ink is transferred out of this roll. The peripheral surface of the brush roll 12' is rotated in the same direction in accordance with, or to the reverse direction against the peripheral surface of the meshed roll 3 in changeable speed by a driving means not shown.

The brushes which centrifugally project from the peripheral surface of the brushed roll 12' are made from material as possess both flexibility for bending and stiffness for repelling, for example, fur of a racoon dog, a pig or a horse as an animal fiber, fiber of nylon, polyester, polypropylene, acrylic, polyvinyl chloride, glass as an artificial fiber. If such fur or fiber are more densely set on the peripheral surface around the brush roll 12', more amount of water will be gathered between them and will be swept away from them.

The brushes are, at first, pressed against the peripheral surface of the meshed roll 3, so that they are bent in close together, and then water is gathered in the closed bending portion of the brushes by capillarity. According to the rotation, as soon as the brushes free from pressure of the meshed roll 3, the brushes return to straighten form the bending state by its own elasticity, thus, water gathering in the closed bending portion of the brushes is swept away. Centrifugal force occurring when the brush roll 12' is rotated at high speed encourages sweeping release of water from the brushes. The brush roll 12' can be operated with oscillating reversals in the direction of rotation so that the direction in which the swept water is released is also reversed to promote distribution in the collection of the released water.

A blade 15' is pressed so as to bend the brushes at the downstream portion in the rotational direction than the point pressed against the meshed roll 3 in the peripheral surface of the brush roll 12'. Thus, the brushes are flipped again after first flipping by freedom from pressure of the meshed roll 3, so that water of which is still remained in the brushes is given again a chance to be swept. It is preferable that pressure of the blade 15' is adjustable in order to respond to the stiffness and/or wear of the brush roll 12'.

A pan 14 for receiving water which has been swept is provided under the brush roll 12', and covers 16 for collecting water which has been flipped are provided around the brush roll 12'.

In the above examples shown in FIGS. 1 to 4, one or more water-removing rolls 12, 12*a* are pressed against the returning portion of the periphery of the meshed roll 3. Also, the water-removing roll train 12, 13 or 12*a*, 13*a* is pressed against it. Therefore, some of the superfluous water 7 is emulsified in the ink, while the remaining water 7 evaporates into the atmosphere. Thus, the superfluous water 7 reaches neither the fountain roll 8 nor the ink pan 9. Hence, it is possible to supply ink from the meshed roll 3 to the cylinder 5 with a constant density. Another advantage arises from the fact that a blade for scraping off water and a water-receiving pan can be dispensed with. Accordingly, the mechanism is simple and inexpensive to manufacture. Further, the operation for discarding the superfluous water is not needed. Consequently, the printing machine can be run very efficiently. If the blade 15 is pressed against the roll 12 or 13, water can be removed more fully.

In the embodiment shown in FIG. 5, at least one water-removing brush roll 12′ is rotatably pressed against the returning portion of the peripheral surface 3*a* of the meshed roll 3, so that the superfluous water 7 on the said peripheral surface 3*a* can be gathered in the bending portion of the brushes by capillarity, and as soon as the brushes free from pressure of the meshed roll 3, water gathered in the closed bending portion is swept away. Thus, the superfluous water 7 reaches neither the fountain roll 8 nor the ink pan 9. Hence, it is possible to supply ink from the meshed roll 3 to the plate cylinder 5 with a constant density. Further advantage arises from the fact that the superfluous water 7 on the meshed roll 3 can be swept away. In case of that the blade 15′ is pressed against the brush roll 12′, the remaining water can be swept away again, so that the effect for removing water from the meshed roll 3 will be further increased.

What is claimed is:

1. A device for removing water from a meshed roll, comprising:

a smoothed roll, being made of rubber or soft resin, for pressing against the returning portion of the meshed roll from which ink has been transferred;

a second smoothed metal roll being in contact with said smoothed roll;

a water removing blade pressed against the periphery of the second smoothed roll; and a container disposed below the blade to recover water.

* * * * *